US007010857B2

(12) United States Patent
Gloaguen

(10) Patent No.: US 7,010,857 B2
(45) Date of Patent: Mar. 14, 2006

(54) PROCESS OF CRIMPING A CONTACT ON STRANDS OF WIRE

(75) Inventor: Daniel Gloaguen, Le Mans (FR)

(73) Assignee: Souriau, Versailles Cedex (FR)

( * ) Notice: Subject to any disclaimer, the term of this patent is extended or adjusted under 35 U.S.C. 154(b) by 80 days.

(21) Appl. No.: 10/622,969

(22) Filed: Jul. 17, 2003

(65) Prior Publication Data

US 2004/0121658 A1 Jun. 24, 2004

(30) Foreign Application Priority Data

Jul. 17, 2002 (FR) ..... 02 09088

(51) Int. Cl.
*H01R 43/04* (2006.01)

(52) U.S. Cl. ..... 29/863; 29/751; 29/857; 29/861; 72/402

(58) Field of Classification Search ..... 29/863, 29/857, 861, 751, 758; 72/410, 402
See application file for complete search history.

(56) References Cited

U.S. PATENT DOCUMENTS 2,369,180 A * 2/1945 Rosenthal ..... 29/566
2,985,047 A * 5/1961 Oort ..... 72/402
3,126,750 A * 3/1964 Willis ..... 74/17.5
5,546,653 A * 8/1996 Tournier et al. ..... 29/751
5,845,393 A * 12/1998 DePaiva ..... 29/751

FOREIGN PATENT DOCUMENTS

DE 1943098 3/1971
EP 0677901 10/1995

* cited by examiner

*Primary Examiner*—Carl J. Arbes
(74) *Attorney, Agent, or Firm*—Boyle Fredrickson Newholm Stein & Gratz S.C.

(57) ABSTRACT

Disclosed is a two-step method for crimping a contact (1) comprising a sleeve (7), the sleeve being provided with a cylindrical portion (14) and a truncated portion (18), about one end (2) of a cable (3) inserted in this sleeve. In the first step, the cylindrical portion is crimped around bared strands (10) of the cable by means of a first jaw (12). In a second step, while the crimping pressure exerted during the first step is maintained, a second jaw (13) is shifted axially along the sleeve so as to apply stress to outer walls of the tapering portion along the bared strands of the cable and also along a sheath (11) of the cable.

20 Claims, 1 Drawing Sheet

PROCESS OF CRIMPING A CONTACT ON STRANDS OF WIRE

BACKGROUND OF THE INVENTION

1. Field of the Invention

An object of the present invention of the method for crimping a contact on strands of a cable. It can be used more particularly in the field of electrical connections, especially in aeronautics, where the connection between a cable and a contact needs to be reliable irrespectively of the external conditions to which it is subjected. These electrical connections are generally subjected to very wide-ranging variations of pressure and temperature because they are installed in aircraft that may fly at altitudes of up to 10,000 meters. For example, for an aircraft, the temperature may vary from −50° C. in the air to +40° C. on the ground.

Furthermore, the variations occur rapidly and are undergone in a span of some hours. The cables are used to connect electronic systems to one another or to a power supply. It is therefore vital to ensure the security of these connections. To this end, the invention is aimed at reducing the consequences of differential expansion phenomena induced by these temperature variations. To do this, the invention proposes a method to ensure the satisfactory crimping of the contact on the cable even when the contact and the cable are made of different materials.

The invention also proposes a solution to ensure the crimping of a contact forming a barrel or sleeve within which the cable is placed so that the sleeve covers bared strands of the cable and, at the same time, a non-bared portion of this cable. In general, the core of a cable is made out of unitary strands which may be made of aluminum, especially for avionics applications. These strands may also be made of copper or similar materials. The strands are surrounded by an insulator sheath generally made of a plastic. The constraint that arises when the cable comprises strands is that the strands may roll around one another during a crimping operation. Furthermore it becomes difficult to hold the contact, even when it is crimped, on these divided wires. It is an object of the invention to overcome these drawbacks related to mechanical behavior and electrical continuity by proposing to connect the contact to the core, namely the strands of the cable, and at the same time to the sheath of the cable.

2. Brief Description of the Prior Art

In the prior art, the patent document FR-A-2,710,788 teaches a crimping method to connect a bared end of an electrical cable to a contact in order to ensure the impervious sealing of the connection. To use the method, the contact should have a barrel or sleeve with a tapered outer rim, this sleeve enabling the cable to be received. This contact is made out of a malleable and conductive material. According to a known method, the crimping is done by wire drawing. One end of the contact is held in the crimping tool while the jaw of the crimping tool is shifted along the tapered rim and folds the sides of the rim along the cable and along the bared end.

In general, the contact which is designed to receive a bared end of a cable in the sleeve has a connection termination at a second end. The contact has a flange between this connection termination and the zone presenting the sleeve. In the invention, it is planned to retain the contact inside the crimping tool at the level of this flange. Indeed, the flange is presented inside a means for holding the crimping tool. Then, after the end of the cable to be crimped has been inserted into the sleeve, the jaw is shifted from the flange-holding means toward the aperture of the sleeve in order to crush the sides of this sleeve on the cable. The shifting of the sleeve exerts radial pressure and, at the same time, axial pressure on the strands of the cable to be crimped. With such a method, there is a risk of disengaging the strands from the sleeve, and even breaking them inside the sleeve, thus giving rise to a connection fault.

The solution of the invention ensures the connection of the strands in the sleeve and, at the same time, their integrity and the impervious sealing of the connection thus made. The impervious sealing of the connection is fundamental to preventing corrosion phenomena. In particular, the present connection using the crimping method according to the invention gives connections that withstand temperature variations and also corrosion by salt spray or salt mist.

It is an object of the invention to carry out the crimping of a contact in which a bared end of the cable is inserted into a sleeve of this contact. Crimping is done at a first level, at a first zone of the sleeve surrounding bared strands of the cable, by a radial clamping motion of a jaw. And to crimp the sleeve throughout its length along this cable end, the closed position of the tool that achieves the first crimping is maintained so as to ensure the position of the strands of the cable relative to the sleeve. Thus, when the sleeve is crimped throughout its length by wire drawing, it is ensured that the length of the strands crimped within the sleeve has a length of engagement that truly corresponds to the planned dimensions. Indeed, the strands of the cable are neither pushed back nor broken inside the sleeve during-the wire drawing operation.

SUMMARY OF THE INVENTION

An object of the invention is a method for crimping a contact on an end of a cable, the contact comprising a sleeve in which the end to crimp is inserted, characterized in that a first jaw of a crimping means is radially clamped on the sleeve so as to crimp it at a first level of the end, this first jaw is kept in the clamped position, while at the same time a second jaw of the crimping means is shifted along the sleeve to crimp the sleeve throughout its length around the end of the cable.

BRIEF DESCRIPTION OF THE DRAWINGS

The invention will be understood more clearly from the following description and from the accompanying figures. These figures are given purely by way of an indication and in no way restrict the scope of the invention. Of these figures.

MORE DETAILED DESCRIPTION

An object of the invention is a crimping method in which it is planned to crimp a contact 1 around an end 2 of a cable 3 by means of a crimping tool 4.

Figure 1:
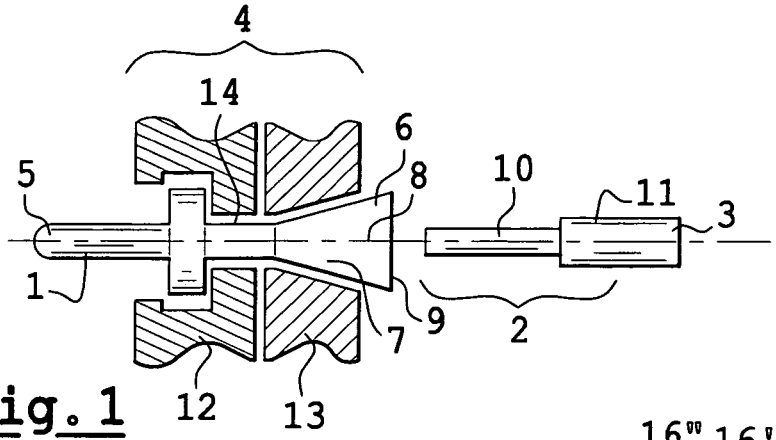
FIG. 1 is a longitudinal sectional view of a contact held in a crimping tool designed to receive the bared cable.

The contact 1 is preferably made of a malleable material. It has a first end 5, which is a front end, designed to cooperate with a matching device. Furthermore, it has a second end 6, which is a rear end, forming a barrel or sleeve 7 to receive the end 2 of the cable 3. In the example shown in FIG. 1, the first end 5 is a male plug designed to cooperate with a female connector of the matching device.

The contact 1 has a main axis of elongation 8 along which the following are presented for their respective connections: firstly, the first end 5 of the contact and secondly the sleeve 7. The sleeve 7 has an aperture 9 that is perpendicular to the axis 8 and opens into the sleeve 7. The inner cavity of the sleeve 7 preferably has a tapered external shape so that the diameter of the aperture 9 is appreciably greater than a diameter of the cable 3, while an inner diameter at the back of the cavity is a diameter slightly smaller than the diameter of the cable 3 surrounded by its sheath 11, while being at the same time slightly greater than the diameter of the bared strands 10 of the cable 3.

Preferably, the contact 1 is made of copper alloy. The cable 3 has metal strands, made especially of aluminum. It is surrounded by a sheath 11 that is preferably insulating and plastic. The invention is especially valuable for this type of connection.

The crimping tool 4 has a first jaw 12 and a second jaw 13. These two jaws 12 and 13 can open so as to permit the introduction of the contact 1 along its axis 8 between parts of the two jaws 12 and 13 respectively. Preferably, the jaws open and close in a direction orthogonal to the axis 8. When the contact 1 is accurately positioned in the crimping means 4, the first jaw 12 gets closed around a tubular portion 14 of the sleeve 7.

The tubular portion 14 has a tubular outer rim situated in the extension of the tapered rim of the sleeve 7, in the extension of the end of this tapered portion that has the smallest diameter. This tubular portion more particularly surrounds the back of the cavity of the sleeve 7.

The second jaw 13 gets closed around the tapered portion of the sleeve 7. To this end, the second jaw 13 has chamfered edges with shapes substantially matching the tapered shape of the sleeve 7.

After the contact 1 has been introduced into the crimping tool 4, the jaws 12 and 13 close in a first holding position in which they exert no direct pressure on the contact. The contact is held in the crimping tool 4, but is still free to undergo slight movement between these two jaws. The holding of the contact 1 in the first jaw 12 enables the end 2 of the cable 3 to be easily inserted into the sleeve 7.

Figure 2:
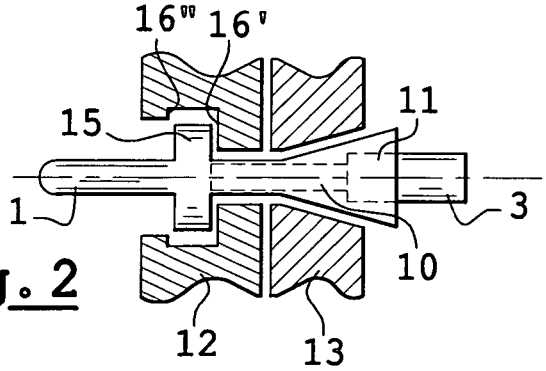
FIG. 2 is a longitudinal sectional view of a contact held in a crimping tool during a first step of a crimping method according to the invention.
Figure 3:
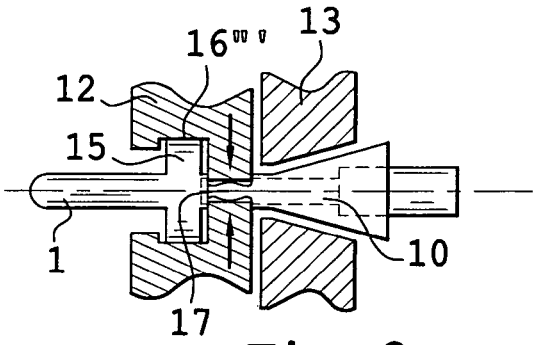
FIG. 3 is a longitudinal sectional view of a contact held in a crimping tool during a second step of a crimping method according to the invention.

As can be seen in FIG. 2, when the end 2 of the cable 3 is inserted into the sleeve 7 during a first step of the crimping method, this end 2 is made to penetrate until at least a part of the bared strands 10 is at the level of the tubular portion 14. The cable 3 is sufficiently bared so that, in the position of being inserted into the sleeve 7, a second part of the bared strands 10 is also located in the tapered portion of the sleeve 7. At this step, the jaws 12 and 13 respectively are only half closed.

The contact 1 preferably has a flange 15 to cooperate with the shoulders 16 of the first jaw 12. Preferably, the first jaw 12 has facing shoulders 16' and 16" between which the flange 15 is held. The cooperation between the chamfered edges and the tapered outer wall also limits the mobility of the contact 1 along the axis 8 inside the crimping tool 4.

Essentially, a jaw such as 12 or 13 respectively comprises one or more moving parts to work together. These parts could approach and move away from each other so as to define a variably sized space between them. Furthermore, these two parts can have their positions adjusted relative to each other so as to get positioned properly either in an open position to receive a contact or in a holding position to hold the contact, or in a crimping position to compress the walls of the contact on the cable 3. In general, these parts are symmetrical to each other. They approach and move away from each other along an axis that is preferably perpendicular to the axis 8 of elongation of the contact 1. As for the second jaw 13, it is furthermore provided with a means of translational motion so that it can be shifted longitudinally along the axis 8.

During a first step, the tubular portion 14 positioned between the moving parts of the first jaw 12 is crimped in a motion of the jaw that is radial relative to the axis 8. The parts of the jaw 12 approach each other so as to apply stress to the portion 14 around the terminal end 17 of the bared strands 10. The parts constituting the jaw 12 are made to approach each other according to radially directed forces. The forces are equivalent. Thus the parts of the first jaw 12 on either side of the portion 14 are made to approach each other. This movement of approaching each other is limited by the presence of the flange 15. Walls 16'" respectively on each of the parts of the jaw 12 abut this flange. Since the contact 1 is held in the crimping means 4 by cooperation with the walls 16' and 16", the movement in which the parts of the jaw 12 approach each other has the simple effect of a radial compression, without any axial stress.

For example, when the part of the jaw 12 are brought together, a slightly domed shape is obtained in the middle and the two ends of the portion 14, which is held between the parts of the jaw 12, are slightly contracted.

Figure 4:
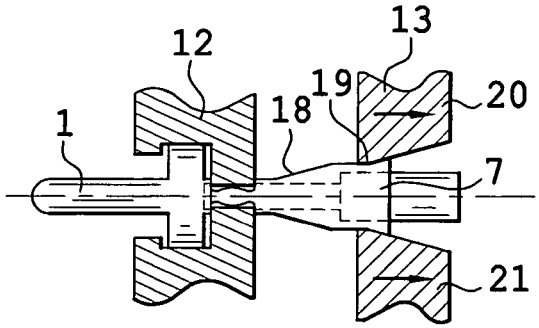
FIG. 4 is a longitudinal sectional view of a contact held in a crimping tool during a third step of a crimping method according to the invention.
Figure 5:
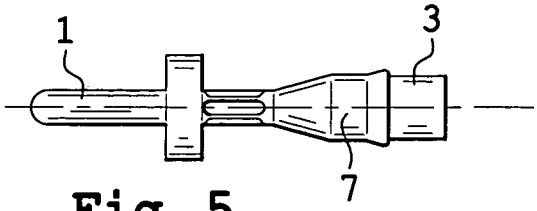
FIG. 5 is a view in profile of a contact crimped on the end of a cable in a method according to the invention.

As can be seen in FIG. 4, during a second step, the first jaw 12 thus remains pushed into the portion 14, while the second jaw 13 for its part is shifted axially along the axis 8 so as to take support on the outer rims 18 of the tapered portion of the sleeve 7. Owing to the shape of the parts of the second jaw 13, the axial shift along the axis 8 of these two parts gives rise to a gradual crushing of the walls 18. These walls are subjected to stress by flat surfaces 19 positioned so as to face each other, respectively on the parts 20, 21 of the second jaw 13. Preferably, the parts 20, 21 are spread apart in such a way that the distance between the flat surfaces 19 is slightly greater than the outer diameter of the bared strands 10 and of the sheath 11. Thus a crimping by wire drawing is obtained, in which the rear sleeve 7, as shown in FIG. 5, is crimped as and when the operation progresses on the bared strands 10 and then on the sheath 11. Thus, a crimping is obtained that gives a slightly tapered shape to the sleeve 7.

By this method, when the second jaw 13 is shifted axially, the strands, on which it gradually crimps the tapered portion 18, are not driven in this same axial motion: they are held at their most terminal end by the first jaw 12. Thus, the integrity of the strands of the cable is ensured even during the crimping operation.

Preferably, in the crimping tool 4, at the beginning of the first crimping step, the two jaws 12 and 13 are attached to each other. Once the first crimping is done at the cylindrical portion 14, the second jaw 13 gradually moves away from the first jaw 12 and gets positioned all along the sleeve 7 throughout its length. This second jaw 13 is shifted up to an end of the sleeve 7, namely up to the aperture 9 of the sleeve 7.

Preferably, the crimping done by the first jaw 12 corresponds to a four-point or eight-point crimping. The number of parts of the first jaw 12 may for example be two and each part may comprise, for example, four pressure points to be applied to the outer rim of the portion 14. In one variant, it may be planned to have only two pressure points on each of the parts of the jaw 12. In this case, to obtain the eight crimping points, it may be planned to impose a rotation of about 45° on the contact 1, and to translate it slightly along the axis 8. In this variant, it is then possible to obtain an arrangement of these eight crimping points in a staggered arrangement on the outer rim of the cylindrical section 14. This special position makes it possible for the crimping to offer greater resistance to axial tensile forces.

In a preferred embodiment, the crimping means 4 comprise a lever or trigger used to successively engage the first jaw 12 around the contact 1 and directly follow up this insertion of the first jaw 12 into the contact 1 with a shifting of the second jaw 13 along this contact 1 to provide for full crimping.

When the crimping by the two jaws 12 and 13 is over, the second jaw 13 automatically comes back to the side of the first jaw 12, and the respective parts of each of the jaws 12 and 13 open again so that the end of the cable, fitted with its contact 1 which is henceforth crimped around it, can come out. In this open position, the clamping tool receives another contact such as 1 to be crimped on another end such as 2.

What is claimed is:

1. Process of crimping a contact on an end of a wire, the contact having an interior shaft through which the end to be crimped is inserted, wherein the process comprises:

radially tightening a first jaw in a crimping manner on the shaft so as to crimp it on a first level on the end, maintaining this first jaw in tightened position, while moving a second jaw along the shaft to crimp it over its length around the end of the wire.

2. Process according to claim 1 wherein the second jaw is moved from the first level up to an opening of the shaft.

3. Process according to claim 2 wherein a partially stripped end is inserted into the interior of the shaft.

4. Process according to claim 3 wherein one crimps a copper shaft on the aluminum strands of the wire.

5. Process according to claim 4 wherein one crimps the wire at eight points with the aid of the first jaw.

6. Process according to claim 5 wherein one exerts a radial pressure on the wire with the first jaw.

7. Process according to claim 6 wherein one pulls a trigger in order to successively crimp the recess of the first jaw and the displacement of the second jaw.

8. Process according to claim 7 wherein the second jaw is closed again around the wire to present an opening slightly larger than the diameter of the wire and slightly smaller than the external diameter of the shaft.

9. A process for crimping a contact on an end of a wire comprising:

(a) providing a contact having an interior shaft through which an end to be crimped is inserted;

(b) inserting the end to be crimped into the contact;

(c) radially tightening a first jaw along the interior shaft to crimp it at or adjacent the end to be crimped;

(d) moving a second jaw along the interior shaft while maintaining the first jaw in a radially tightened position.

10. A process for crimping a contact on an end of a wire comprising:

(a) providing a contact having a copper shaft and a wire having aluminum strands;

(b) inserting the aluminum strands to be crimped into the contact;

(c) radially tightening a first jaw on the shaft of the contact to crimp it at a first location of the end;

(d) moving a second jaw along the copper shaft of the contact while maintaining the first jaw in a radially tightened position.

11. A process for crimping a contact on an end of a wire comprising:

(a) providing a contact having a shaft and a wire having strands;

(b) inserting the strands to be crimped into the contact;

(c) radially tightening a first jaw on the shaft of the contact to crimp it at a first location;

(d) moving a second jaw along the shaft of the contact while maintaining the first jaw in a radially tightened position; and (e) wherein the shaft of the contact and the strands of the wire are crimped at a plurality of pairs of points along the shaft.

12. A process for crimping a contact on an end of a wire comprising:

(a) providing a contact having a shaft and a wire having strands;

(b) inserting the strands to be crimped into the contact;

(c) radially tightening a first jaw on the shaft of the contact to crimp it at a first location;

(d) moving a second jaw along the shaft of the contact while maintaining the first jaw in a radially tightened position; and (e) opening and closing the second jaw to produce an opening larger than the diameter of the wire and smaller than the outer diameter of the shaft.

13. Process according to claim 10 wherein the first jaw crimps the shaft of the contact in between a plurality of the ends of the contact before the second jaw is moved along a tubular outer sidewall of the interior shaft to crimp the contact to an electrically conductive portion of the wire.

14. A process for crimping a contact on an end of a wire comprising:

(a) providing a contact having a tubular shaft section through which an end to be crimped is inserted;

(b) inserting one end of the wire to be crimped into the contact;

(c) radially tightening a first jaw along the interior shaft to crimp it adjacent the end of the wire; and (d) moving a second jaw in a longitudinal direction along the tubular shaft section crimping the tubular shaft section of the contact to the wire while the first jaw is constraining movement of the contact in a longitudinal direction during at least part of the time the second jaw is crimping the contact to the wire in step (c).

15. A process according to claim 14 wherein during step (c) the first jaw is disposed between a radially outwardly extending flange of the contact and the second jaw thereby defining an abutment against which the radially outwardly extending flange can abut during crimping in step (d) to prevent the contact from moving relative to the first jaw.

16. A process according to claim 14 wherein during step (c) the first jaw crimps the contact by impressing a plurality of circumferentially spaced apart and longitudinally extending oblong indentions into the contact.

17. A process for crimping a contact on an end of a wire comprising:

(a) providing a contact having an aperture adjacent one end and an elongate electrically conductive contact section disposed adjacent another end wherein the contact includes a radially outwardly extending flange located between the ends, a cable having an insulating sheath and an electrical conductor extending outwardly from the insulating sheath, and a crimping tool that includes a first crimping jaw having a plurality of jaw segments movable relative to one another and a second crimping jaw having a plurality of jaw segments movable relative to one another;

(b) inserting the electrical conductor of the cable into the aperture in the contact such that a portion of the electrical conductor and contact overlap;

(c) positioning the first jaw adjacent the contact adjacent the flange of the contact;

(d) positioning the second jaw adjacent the end of the contact adjacent the aperture;

(e) moving at least one of the plurality of jaw segments of the first jaw toward another one of the plurality of jaw segments of the first jaw and toward the contact thereby locating at least one of the plurality of jaw segments of the first jaw between the radially outwardly extending flange of the contact and the second jaw;

(f) moving at least one of the plurality of jaw segments of the second jaw (i) radially toward another one of the plurality of jaw segments of the second jaw and radially toward the contact and into engagement with the sleeve of the contact deforming the contact, and (ii) axially along the sleeve of the contact in a longitudinal direction relative the contact deforming the sleeve around the electrical conductor of the cable while at least one of the jaw segments is engageable with the radial flange of the contact to oppose axial movement of the contact relative to the first jaw crimping the contact around the cable at least during step (f)(ii).

18. A process according to claim 17 wherein during step (e) the first jaw is disposed between the flange of the contact and the second jaw defining an abutment against which the flange is stoppable during crimping in step (f) to prevent the contact from moving relative to the first jaw.

19. A process according to claim 17 wherein during step (e) the first jaw crimps the contact and puts a plurality of circumferentially spaced apart and longitudinally extending oblong indentions into an contact outer sidewall.

20. A process according to claim 17 wherein the first jaw crimps the contact during step (e) and the second jaw crimps the contact during step (f) in order and without any engagement between the first jaw and second jaw during crimping.

* * * * *